US007188636B1

(12) United States Patent
Kanne et al.

(10) Patent No.: US 7,188,636 B1
(45) Date of Patent: Mar. 13, 2007

(54) CONTAINMENT CART

(76) Inventors: Steve Kanne, 20274 Jeannie La., Gretna, NE (US) 68028; Brian Kenkel, 21635 Chancellor Rd., Elkhorn, NE (US) 68022; David Kanne, 24347 190th St., Carroll, IA (US) 51401; Jimmy Judd, 11118 Famam St., Omaha, NE (US) 68154

( * ) Notice: Subject to any disclaimer, the term of this patent is extended or adjusted under 35 U.S.C. 154(b) by 376 days.

(21) Appl. No.: 10/824,521

(22) Filed: Apr. 14, 2004

(51) Int. Cl.
*E04G 23/00* (2006.01)
*E04H 15/44* (2006.01)
*E04H 15/00* (2006.01)
*B08B 15/00* (2006.01)

(52) U.S. Cl. ..... 135/142; 135/157; 135/900; 52/63; 52/DIG. 12; 55/385.2; 454/63; 454/189

(58) Field of Classification Search ..... 55/365, 55/385.2, 357; 454/66, 189, 194, 63; 135/900, 135/901, 139–142, 156–158, 131, 91, 93; 52/63, DIG. 12
See application file for complete search history.

(56) References Cited

U.S. PATENT DOCUMENTS 2,612,900 A * 10/1952 Treppa ..... 135/141
3,766,844 A * 10/1973 Donnelly et al. ..... 454/238
4,682,448 A 7/1987 Healey ..... 52/63
4,706,551 A * 11/1987 Schofield ..... 454/66
4,883,512 A 11/1989 Griffis ..... 55/356
4,928,581 A * 5/1990 Jacobson ..... 454/340
4,934,396 A * 6/1990 Vitta ..... 135/139
5,062,871 A * 11/1991 Lemon, III ..... 55/385.2
5,558,112 A 9/1996 Strieter ..... 134/103.2
6,383,242 B1 5/2002 Rogers et al. ..... 55/385.2
6,783,563 B1 * 8/2004 Eckhoff et al. ..... 55/356

FOREIGN PATENT DOCUMENTS

GB 2 165 276 A * 9/1986

* cited by examiner

*Primary Examiner*—Robert Canfield
(74) *Attorney, Agent, or Firm*—Thomte, Mazour & Niebergall; Shane M. Niebergall

(57) ABSTRACT

A portable enclosure apparatus is provided with a frame assembly having a bottom wall, an upper frame member and a single pair of vertical support members. The support members are easily length adjusted by a single user to vary the height of the system while in use. The frame assembly can be quickly disassembled for convenient storage and transport. A cover envelopes the frame assembly to complete the enclosure. A portable dust collector can be coupled with the cover to secure airborne debris moving into the enclosure.

20 Claims, 4 Drawing Sheets

CONTAINMENT CART

BACKGROUND OF THE INVENTION

1. Field of the Invention

The present invention relates to containment units used to provide above-ceiling construction and repair while limiting the exposure of the surrounding environment to falling debris and potentially harmful materials released as a result of the construction or repair work. More specifically, the present invention relates to a containment cart that can be easily assembled, used and later disassembled and transported by a single person.

2. Description of the Prior Art

From time to time, construction and repair work in above-ceiling areas becomes necessary in nearly any home or building. It is easy to understand the mess that can be generated when performing such construction and repair work. Where a drop-ceiling is not provided, ceiling material may need to be cut and removed in pieces, which causes dust and debris to fall and become airborne. Frequently, the area above the ceiling will contain insulation or other materials. These materials may be harmful to the health of those near the area, let alone the surrounding spaces and property.

Several different types of containment units have been designed to limit the exposure of people and the surrounding environment to falling and airborne debris occurring during above-ceiling construction or repair work. One example of such a containment unit is described by Healey in U.S. Pat. No. 4,682,448. The Healey patent teaches an enclosure that can be positioned beneath the construction area, extending from the floor to the ceiling to provide an enclosure in which the worker operates. The containment unit is generally comprised of a rigid frame assembly and an enclosure that is constructed of a flexible material. While the Healey containment unit provides assistance in containing the debris, it suffers from a number of shortcomings. First, the structure of the frame assembly is not provided in such a manner that it can be easily disassembled into a plurality of smaller component parts for ease of storage or transport. Second, the frame assembly is designed in such a manner that it is difficult for a single user to adjust and operate. Other prior art designs, such as U.S. Pat. No. 5,558,112 and U.S. Pat. No. 6,383,242, suffer from these same shortcomings. However, the designs of these and similar prior art containment units are more complex and intricate than the containment unit disclosed by Healey. Accordingly, such containment units have become relatively complex and expensive to manufacture, rendering them impractical for many operations.

Accordingly, what is needed is a containment unit, which provides an enclosure for receiving falling and airborne debris caused by work being performed above a ceiling, that is simple in design for ease of construction and use.

SUMMARY OF THE INVENTION

The containment cart of the present invention is generally provided with a frame assembly and a cover. The frame assembly is constructed with a bottom wall sufficient for supporting a worker. An upper open frame member is coupled to the bottom wall by a pair of opposing support members that are positioned proximal a long or short axis of the bottom wall. In one embodiment, the support members are selectively length-adjustable to allow a user to vary the height of the containment cart. Gripping members may be provided to permit a single user to adjust the height of the containment cart at any point during its use. Another embodiment provides the unit with a portable dust collection unit that it is releasably coupled to the cover. In still another preferred embodiment, each of the component parts of the system can be easily disassembled for storage or transport. Casters coupled to the bottom wall provide the containment cart with ease of mobility and positioning.

It is therefore one of the principle objects of the present invention to provide a containment cart that can be height-adjusted by a single user while the containment cart is in use.

A further object of the present invention is to provide a containment cart that can be easily disassembled for storage and transport.

Still another object of the present invention is to provide a containment cart that is relatively simple and inexpensive to manufacture.

Yet another object of the present invention is to provide a containment cart having a frame assembly that uses only a single pair of support members without sacrificing strength or stability.

These and other objects of the present invention will be apparent to those skilled in the art.

DESCRIPTION OF THE PREFERRED EMBODIMENT

Figure 1:
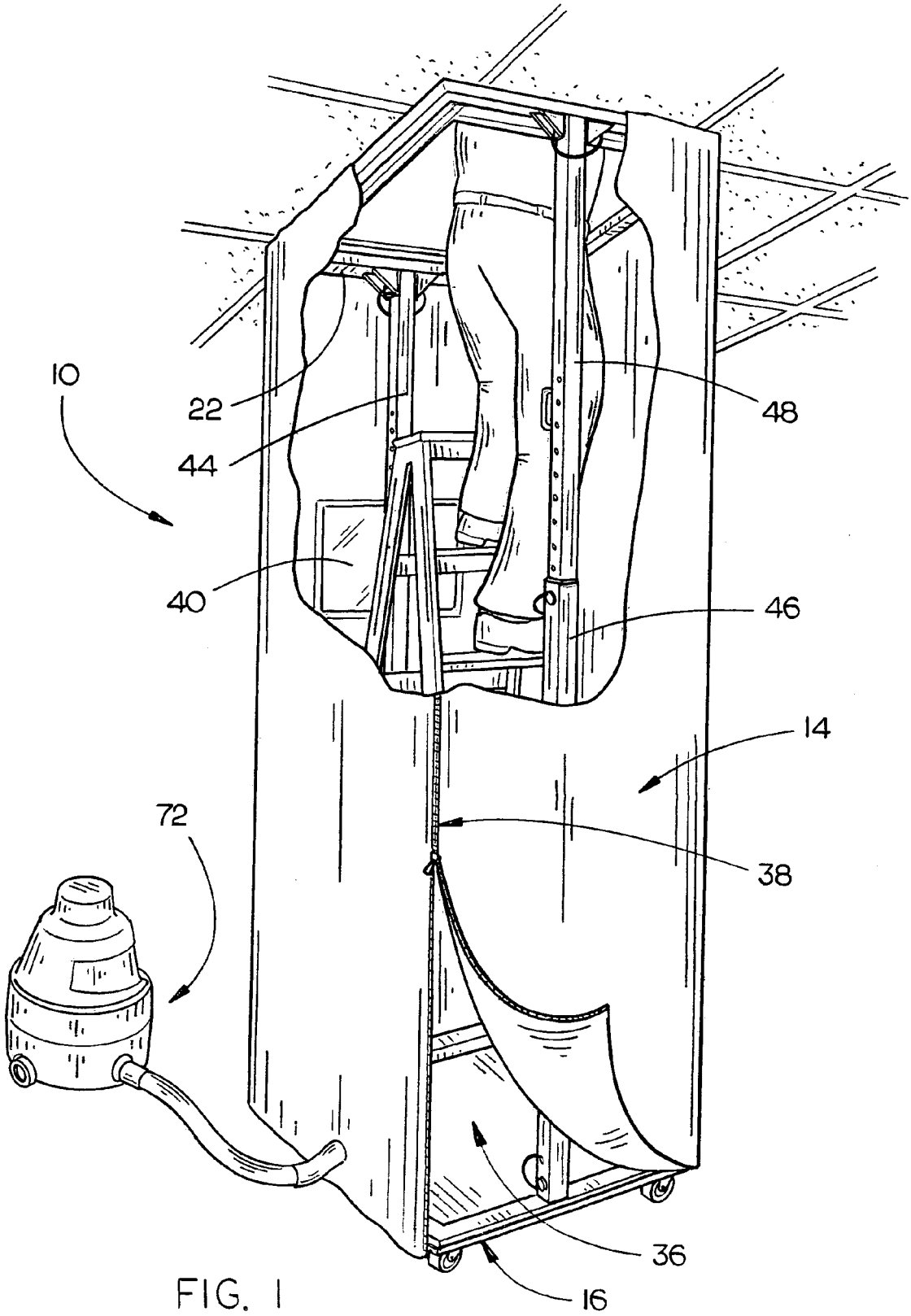
FIG. 1 is a perspective view of one embodiment of the containment cart of the present invention, depicting one contemplated use of the same.

The containment cart 10 of the present invention is generally depicted in FIGS. 1–4. While the containment cart 10 will be described herein as being used for the containment and collection of debris resulting from construction or repair work in and above a ceiling in a home or office, it will be understood by those of skill in the art that the containment cart 10 could be used in a wide array of applications and industries. Accordingly, the following description should not be construed as limiting the available uses for the containment cart 10 or the number of different embodiments of the containment cart 10 that could be derived through the combination of the following described preferred elements.

The containment cart 10 is generally comprised of a frame assembly 12 and an enclosure means 14. The frame assembly 12 is provided with a bottom wall 16, which may be formed as a single unit or constructed of a bottom frame member 18 and a bottom platform 20. An upper frame member 22 is supported above the bottom wall 16 by a first elongated support 24, having opposite first and second end portions 26 and 28, and a second elongated support member 30, having opposite first and second end portions 32 and 34. Due to the fact that only two elongated support members are provided in the design of the frame assembly 12, it is preferred that the first and second elongated frame members 24 and 30 engage the bottom wall 16 at coupling points that share a common axis, which extends through the bottom wall 16 adjacent a long axis "A", as depicted in FIG. 2.

However, the first and second elongated support members 24 and 30 could also be positioned so that the common axis extends through the bottom wall 16 adjacent a short axis "B" of the bottom wall 16. In either arrangement, the elongated support members 24 and 30 provide stable support to the upper frame member 22. It is contemplated that the elongated support members 24 and 30 do not need to extend outwardly from points resting directly on the long axis "A" (or short axis "B"). Rather, the elongated support members 24 and 30 could engage the bottom wall 16 a short distance away from the long axis "A" (or short axis "B"). However, as the elongated support members 24 and 30 are positioned further away from the long axis "A" (or short axis "B"), the bottom wall 16 and the upper frame member 22 will cantilever a greater distance from the elongated support members 24 and 30 in one direction, which could increase the likelihood of instability.

Figure 2:
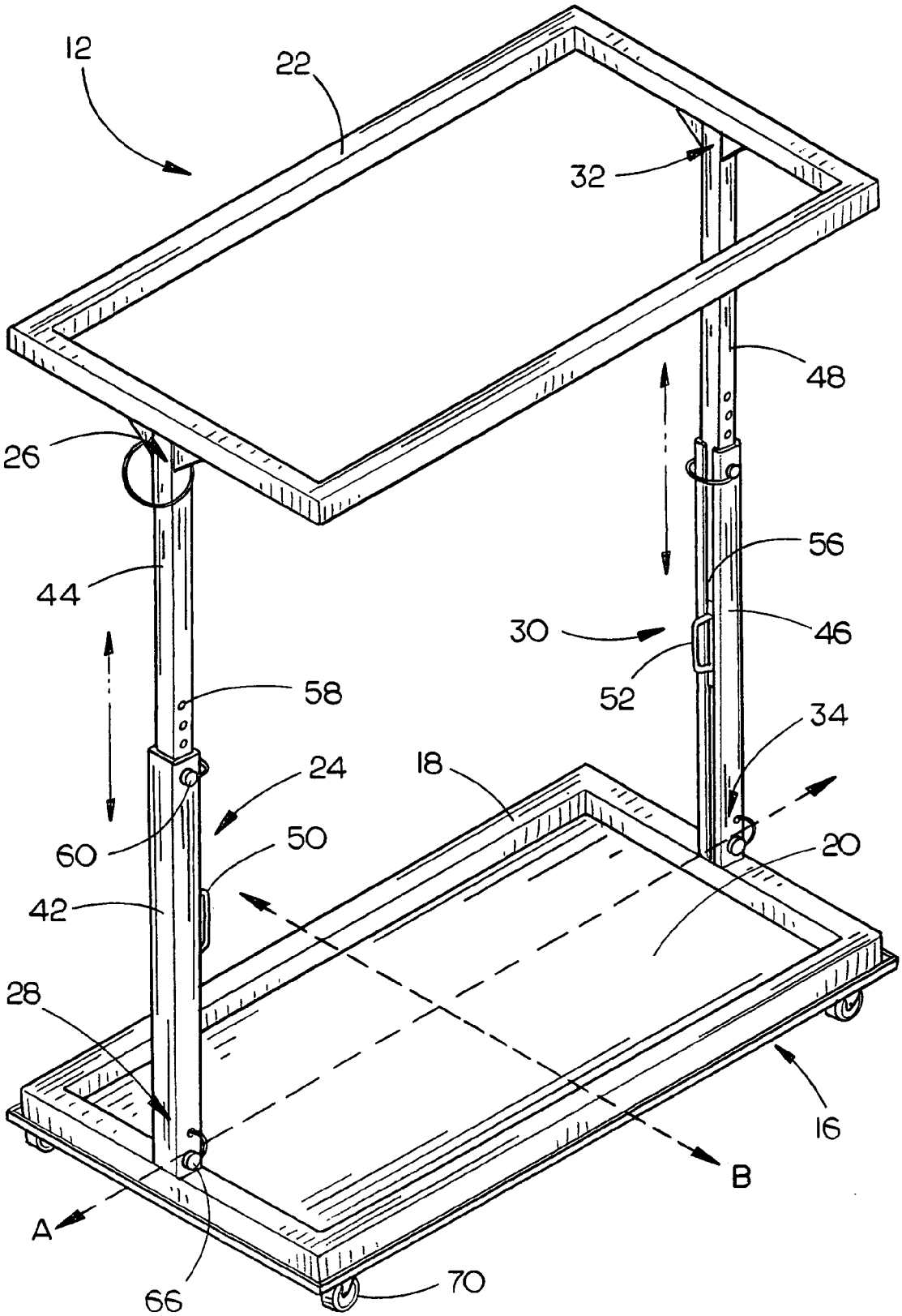
FIG. 2 is an isometric view of one embodiment of the frame assembly of the containment cart of the present invention.

The bottom wall 16 depicted in FIG. 2 is rectangularly shaped. Accordingly, a long axis "A" and a short axis "B" are easily defined. However, it is contemplated that the bottom wall 16 could be provided in nearly any shape, having any number of sides. Accordingly, other known shapes such as an oval, an ellipse, and many polygons will have an easily defined long axis "A" and short axis "B", whereas other shapes such as circles and squares will have different vectored axis that are not as easily defined. Accordingly, the "long axis" of uniform shapes such as circles and squares will be considered to be any axis extending through the shaped base wall and the "short axis" will simply be the axis extending through the shaped base wall that is perpendicular to, but in the same plane as, the "long axis." While it is not imperative, it is contemplated that the upper frame member 22 will be shaped and sized to approximate the bottom frame member 18. The second end portions 26 and 32 of the elongated support members 24 and 30 will be positioned to engage the upper frame member 22 in a manner similar to that described for the first end portions 28 and 34 and the bottom wall 16.

The enclosure means 14 will preferably be comprised of nearly any flexible material and extend at least between the bottom wall 16 and the upper frame member 22 such that a generally enclosed chamber 36 is defined. A seam or doorway 38 should be formed along one side of the enclosure means 14 and secured in a conventional fashion with a zipper, hook-and-loop fastener, or the like. Where a translucent material is used to construct the enclosure means 14, it may be desirable to provide a window 40, formed of a transparent material, in the enclosure means 14. Bottom and/or top walls can be formed into the enclosure means 14 and provided with openings having conventional fastening means. Desirably, the material selected for the enclosure means 14 will be lightweight and durable. Where flexibility is not desired or is unimportant, rigid wall members can be provided to form the enclosed chamber 36. One or more portable dust collectors 72 can be coupled with the enclosure means 14 to secure airborne debris moving into the chamber 36, as depicted in FIG. 1

In a preferred embodiment, the frame assembly 12 will be height-adjustable to permit use of the containment cart in different areas of various ceiling heights. Accordingly, the elongated support members 24 and 30 should have a length-adjustable design. In one embodiment, the first elongated support member 24 is provided with a base portion 42 that telescopically receives an extension portion 44 therein. Similarly, the second elongated support member 30 is provided with a base portion 46 that telescopically receives an extension portion 48. As depicted in FIG. 2, the extension portions 44 and 48 can be selectively moved between extended and retracted positions to selectively position the upper frame member 22 at a desired height above the bottom wall 16. Due to the fact that only two support members are used, a pair of gripping members 50 and 52 can be secured to the extension portions 44 and 48, respectively. It is contemplated that the gripping members 50 and 52 could simply be provided as rigid handles, knobs, flexible straps, or the like. In this manner, a user can simply grip one or both of the gripping members 50 and 52 and raise the extension portions 44 and 48 and the upper frame member 22 to the desired height. Where the extension portions 44 and 48 are made to telescope within the base portions 42 and 46, as depicted in FIG. 2, channels 54 and 56 can be formed within the base portions 42 and 46 to at least partially receive the gripping members 50 and 52 to allow their passage along the length of the bottom portions 42 and 46. It is also contemplated however that the extension portions 44 and 48 could be fashioned to telescopically receive the base portions 42 and 46 therein, which would render the need for forming the channels 54 and 56 moot. In order to secure the extension portions 44 and 48 in the selected positions, a plurality of openings 58 should be formed along the lengths of the extension portions 44 and 48, which could be shaped and sized to receive a retaining pin 60. However other embodiments of conventional securement means between the telescoping sections are contemplated.

Figure 3:
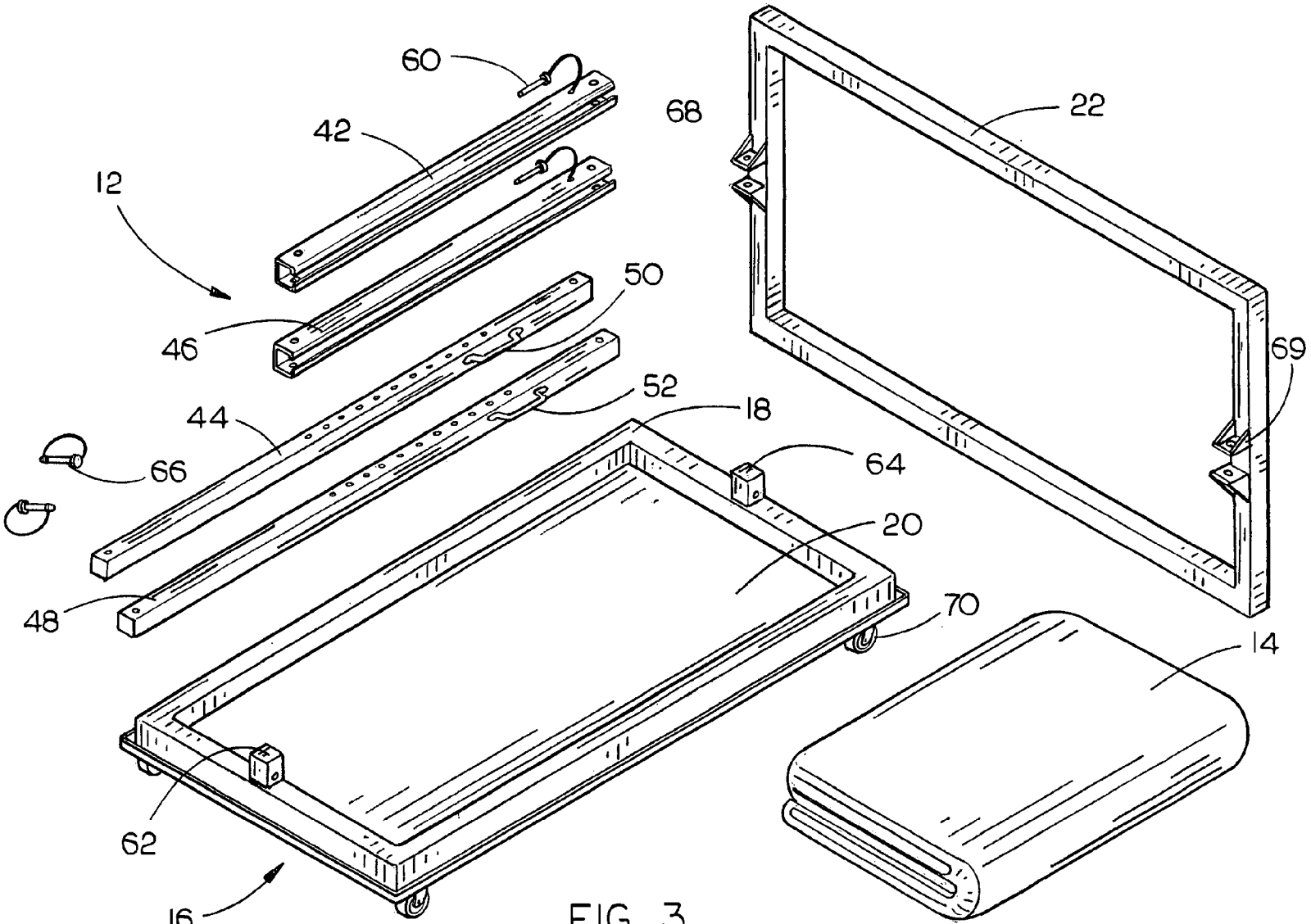
FIG. 3 depicts the containment cart of FIG. 1 as the same could be disassembled for storage or transport.
Figure 4:
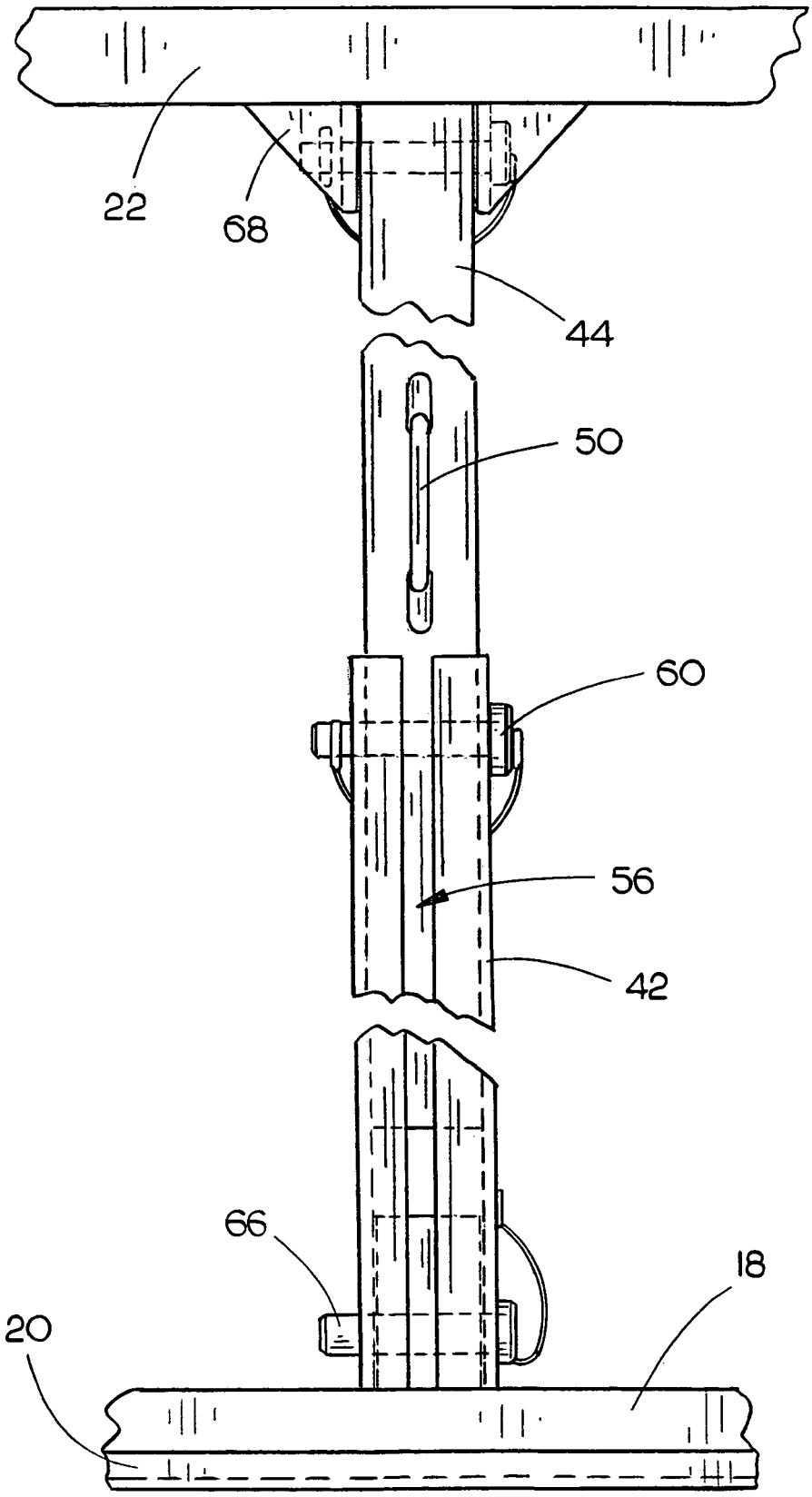
FIG. 4 is a partial side elevation view of one embodiment of a length-adjustable support member of the containment cart of the present invention.

Desirably, the containment cart 10 will be easily stored and transported. To that end, the flexible nature of the enclosure means 14 will permit the same to be neatly folded. The frame assembly 12 should be provided in a number of separate components that can easily be packed in a relatively flat and narrow space. For example, the bottom wall 16 could be provided in a single unit or as a separate bottom frame member 18 and the platform 20. The bottom frame member 18 and the platform 20 could be removably coupled to one another using conventional fastener means or simply coupled by placing the bottom frame member 18 atop the platform 20. The first and second elongated support members 24 and 30 could be removably coupled to the bottom wall 16 using a pair of support posts 62 and 64 which could be received by the first end portions 28 and 34 of the elongated support members 24 and 30. To secure this removable connection, it is contemplated that removable pins 66 or other conventional fastening means could be used. The second end portions 26 and 32 of the elongated support members 24 and 30 could be removably coupled to the upper frame member 22 using a similar post-and-receiver design or, as with the first end portions 28 and 34, the second end portions 26 and 32 can be removably coupled to the adjoining structure using a pair of bracket members 68 and 69, as depicted in FIG. 3. Pin members similar to pins 66 or other conventional fastening means could be employed to secure the pairs of brackets 68 and 69 to the second end portions 26 and 32. Accordingly, the simple design of the frame assembly 12 permits the quick assembly and disassembly of the same by a single user. Moreover, the manner in which the frame assembly 12 disassembles allows it to be stored or transported in a small space.

To facilitate the ease with which the containment cart 10 is positioned, it is contemplated that a plurality of casters 70 could be coupled to the bottom wall 16. In keeping with the principle of being able to disassemble the containment cart 10 for storage or transport, it is contemplated that the casters 70 could be provided with a quick release securement system or other known conventional fasteners, such as bolts and screws.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

We claim:

1. A portable enclosure apparatus, comprising:

a frame assembly having a bottom wall with a peripheral edge portion, an upper frame member, and first and second support members with opposite end portions operatively coupled with said bottom wall and said upper frame member; said first and second support members being positioned to extend outwardly from said bottom wall from a common central axis that extends through said bottom wall proximal a long or a short axis of said bottom wall; and enclosure means operatively coupled with said bottom wall and said upper frame member for generally forming a chamber extending between said bottom wall and said upper frame member.

2. The apparatus of claim 1 wherein said first and second support members have a length that is selectively adjustable between extended and retracted positions.

3. The apparatus of claim 2 wherein said first and second support members are comprised of first and second portions that are selectively telescopically movable with respect to one another.

4. The apparatus of claim 3 wherein the first portions of said first and second support members are provided with gripping means for selective manipulation by a user to telescopically set a desired length for said first and second support members.

5. The apparatus of claim 4 wherein the second portions of said first and second support members are provided with receiving means for at least partially receiving said gripping means when said first and second support members are adjusted between said extended and retracted positions.

6. The apparatus of claim 1 wherein said bottom wall is comprised of a bottom frame member and a bottom platform.

7. The apparatus of claim 6 wherein said upper frame member and said bottom platform are of similar dimensions.

8. The apparatus of claim 7 wherein said bottom wall is selectively removably coupled with said first and second support members and said first and second support members are removably coupled with said upper frame so that said frame assembly may be selectively collapsed for storage or transport.

9. The apparatus of claim 8 wherein said bottom frame member and said bottom platform are removably coupled with one another.

10. The apparatus of claim 9 further comprising a plurality of casters coupled to said bottom wall so that said frame assembly may be selectively positioned along an operating surface.

11. The apparatus of claim 10 wherein said casters are removably coupled with said bottom wall.

12. The apparatus of claim 2 wherein said bottom wall is selectively removably coupled with said first and second support members and said first and second support members are removably coupled with said upper frame so that said frame assembly may be selectively collapsed for storage or transport.

13. The apparatus of claim 12 wherein the first portions of said first and second support members are provided with gripping means for selective manipulation by a user to telescopically set a desired length for said first and second support members.

14. The apparatus of claim 13 further comprising a plurality of casters coupled to said bottom wall so that said frame assembly may be selectively positioned along an operating surface.

15. The apparatus of claim 1 wherein said bottom wall has a forward edge portion and a rearward edge portion and said first support member extends outwardly from a point proximal the center of said forward edge portion and said second support member extends outwardly from a point proximal the center of said rearward edge portion.

16. The apparatus of claim 15 wherein said first and second support members have a length that is selectively adjustable between extended and retracted positions.

17. The apparatus of claim 16 wherein said bottom wall is selectively removably coupled with said first and second support members and said first and second support members are removably coupled with said upper frame so that said frame assembly may be selectively collapsed for storage or transport.

18. The apparatus of claim 17 wherein the first portions of said first and second support members are provided with gripping means for selective manipulation by a user to telescopically set a desired length for said first and second support members.

19. The apparatus of claim 18 wherein the second portions of said first and second support members are provided with receiving means for at least partially receiving said gripping means when said first and second support members are adjusted between said extended and retracted positions.

20. The apparatus of claim 19 further comprising a plurality of casters coupled to said bottom wall so that said frame assembly may be selectively positioned along an operating surface.

* * * * *